US008382607B2

(12) United States Patent
Burnett et al.

(10) Patent No.: US 8,382,607 B2
(45) Date of Patent: Feb. 26, 2013

(54) LENGTH ADJUSTMENT SYSTEM FOR JOINING A GOLF CLUB HEAD TO A SHAFT

(75) Inventors: Michael Scott Burnett, McKinney, TX (US); Jason Sulak, Richardson, TX (US)

(73) Assignee: Taylor Made Golf Company, Inc, Carlsbad, CA (US)

( * ) Notice: Subject to any disclaimer, the term of this patent is extended or adjusted under 35 U.S.C. 154(b) by 253 days.

(21) Appl. No.: 12/961,652

(22) Filed: Dec. 7, 2010

(65) Prior Publication Data

US 2012/0142445 A1 Jun. 7, 2012

(51) Int. Cl.
*A63B 53/02* (2006.01)

(52) U.S. Cl. ..... 473/307; 473/288; 473/309; 473/246; 473/338; 473/296

(58) Field of Classification Search ..... 473/239, 473/296, 298–299, 307, 309, 288, 244–248, 473/334–339, 345, 349
See application file for complete search history.

(56) References Cited

U.S. PATENT DOCUMENTS

| | | | | |
|---|---|---|---|---|
| 5,039,098 | A | 8/1991 | Pelz | |
| 5,513,844 | A | 5/1996 | Ashcraft et al. | |
| 5,839,973 | A | 11/1998 | Jackson | |
| 6,769,996 | B2 | 8/2004 | Tseng | |
| 7,083,529 | B2 | 8/2006 | Cackett et al. | |
| 7,207,897 | B2 | 4/2007 | Burch et al. | |
| 7,335,113 | B2 | 2/2008 | Hocknell et al. | |
| 7,438,645 | B2 | 10/2008 | Hsu | |
| 7,476,160 | B2 | 1/2009 | Hocknell et al. | |
| 7,566,279 | B2 | 7/2009 | Nakashima | |
| 7,699,717 | B2 | 4/2010 | Morris et al. | |
| 2009/0062029 | A1 | 3/2009 | Stites et al. | |
| 2009/0286611 | A1* | 11/2009 | Beach et al. | 473/246 |
| 2009/0286619 | A1 | 11/2009 | Beach et al. | |
| 2010/0197424 | A1* | 8/2010 | Beach et al. | 473/307 |
| 2010/0234123 | A1 | 9/2010 | Sato et al. | |

OTHER PUBLICATIONS

International Search Report and Written Opinion of the International Searching Authority for International Application No. PCT/US2011/057966, mailed Mar. 8, 2012, 8 pages.

* cited by examiner

*Primary Examiner* — Stephen L. Blau
(74) *Attorney, Agent, or Firm* — David J. Dawsey; Michael J. Gallagher; Gallagher & Dawsey Co., LPA

(57) ABSTRACT

A length adjustment system for joining a golf club head to a shaft is provided. The length adjustment system may be utilized to produce a minor length, an intermediate length, and an extended length of a golf club. In a minor length configuration, the length adjustment system includes a shaft sleeve attached to an end of the shaft. A retainer releasably secures the shaft and shaft sleeve to the golf club head. The minor length configuration also features a minor length weight system. The intermediate length configuration further includes a first spacer, a first hosel sleeve, and an intermediate length weight system. The extended length configuration further includes a second spacer, a second hosel sleeve, and an extended length weight system. The length adjustment system incorporates the discovery of unique relationships among its components so that the resulting golf club has similar characteristics in each configuration.

22 Claims, 8 Drawing Sheets

LENGTH ADJUSTMENT SYSTEM FOR JOINING A GOLF CLUB HEAD TO A SHAFT

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present disclosure relates to sports equipment, and more particularly, to a length adjustment system for joining a golf club head to a shaft.

BACKGROUND OF THE INVENTION

Today's golfers are constantly seeking means for improving their game. One avenue for improvement that golfers are turning to is the adjustable, or customizable, golf club. Previously, the United States Golf Association (USGA) rules permitted golf clubs to be adjustable only with respect to the weight of the golf club. However, since 2008, the USGA has allowed golf clubs to be designed with adjustable features other than weight, such as lie, face angle, and/or length. As a result, golfers now have a number of options for customizing a golf club to fit their particular preferences.

One particular aspect of the game where many golfers seek improvement is distance. It is generally accepted that increasing the length of a golf club will result in increased distance due to the generation of greater club head speed at the point of impact. However, some golfers who wish to play increased length clubs find it more difficult to hit the golf ball with the same level of accuracy as standard length clubs. This decrease in accuracy may be due to substantial changes in the characteristics of the golf club, such as the golf club's center of gravity location and the golf club's moment of inertia.

There remains a need in the art for golf clubs that are capable of being adjusted in length that do not substantially alter the characteristics of the golf club, which may lead to a decrease in a golfer's accuracy.

SUMMARY OF THE INVENTION

In its most general configuration, the presently disclosed length adjustment system for joining a golf club head to a shaft advances the state of the art with a variety of new capabilities and overcomes many of the shortcomings of prior methods in new and novel ways. In its most general sense, the presently disclosed length adjustment system overcomes the shortcomings and limitations of the prior art in any of a number of generally effective configurations.

The present disclosure is directed to a length adjustment system for joining a golf club head to a shaft. The length adjustment system for joining a golf club head to a shaft generally includes a number of components that may be utilized to create a number of golf club configurations. For example, in one embodiment, the length adjustment system may be used to produce a minor length of a golf club and an intermediate length of a golf club. In this embodiment, the length adjustment system includes a shaft sleeve attached to an end of the shaft that cooperates with a hosel of the golf club head. A retainer is provided to releasably secure the shaft to the golf club head. The length adjustment system also includes at least a first spacer, a first hosel sleeve, and at least a minor length weight system and an intermediate length weight system.

In a minor length configuration, the shaft sleeve is releasably secured to the golf club head by the retainer to produce a minor length of a golf club. Additionally, the minor length configuration has a minor length weight comprising the weight of the golf club head, the shaft sleeve, the retainer, and the minor length weight system. The minor length weight produces a minor length center of gravity and a minor length moment of inertia.

In an intermediate length configuration, the shaft sleeve, the first spacer, and the first hosel sleeve are releasably secured to the golf club head by the retainer to produce an intermediate length of a golf club. The intermediate length configuration has an intermediate length weight comprising the weight of the golf club head, the shaft sleeve, the first spacer, the first hosel sleeve, the retainer, and the intermediate length weight system. The intermediate length weight produces an intermediate length center of gravity and an intermediate length moment of inertia.

In this particular embodiment of the length adjustment system, the intermediate length is at least ¼ inch greater than the minor length. Moreover, the intermediate length weight is within 5 percent of the minor length weight. Additionally, the intermediate length moment of inertia is within 10 percent of the minor length moment of inertia. Still further, the X, Y, and Z coordinates of the intermediate length center of gravity are all within 15 percent of the X, Y, and Z coordinates of the minor length center of gravity. As a result of these relationships, each configuration of the golf club has similar characteristics and a consistent feel.

In another embodiment, the components of the length adjustment system may be used to produce a minor length, an intermediate length, and an extended length of a golf club. This particular embodiment of the length adjustment system incorporates the components utilized to produce a minor length and an intermediate length golf club, and further includes a second spacer, a second hosel sleeve, and an extended length weight system to produce an extended length of a golf club.

In an extended length configuration, the shaft sleeve, the second spacer, and the second hosel sleeve are releasably secured to the golf club head by the retainer to produce an extended length of a golf club. The extended length configuration has an extended length weight comprising the weight of the golf club head, the shaft sleeve, the second spacer, the second hosel sleeve, the retainer, and the extended length weight system. The extended length weight produces an extended length center of gravity and an extended length moment of inertia.

In this particular embodiment of the length adjustment system, the extended length is at least ¼ inch greater than the intermediate length. Moreover, the extended length weight is within 5 percent of the minor length weight. Additionally, the extended length moment of inertia is within 15 percent of the minor length moment of inertia. Still further, the X, Y, and Z coordinates of the extended length center of gravity are all within 15 percent of the X, Y, and Z coordinates of the intermediate length center of gravity. As a result of these relationships, each configuration of the golf club has similar characteristics and a consistent feel.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the length adjustment system for joining a golf club head to a shaft as claimed below and referring now to the drawings and figures:

Figure 1:
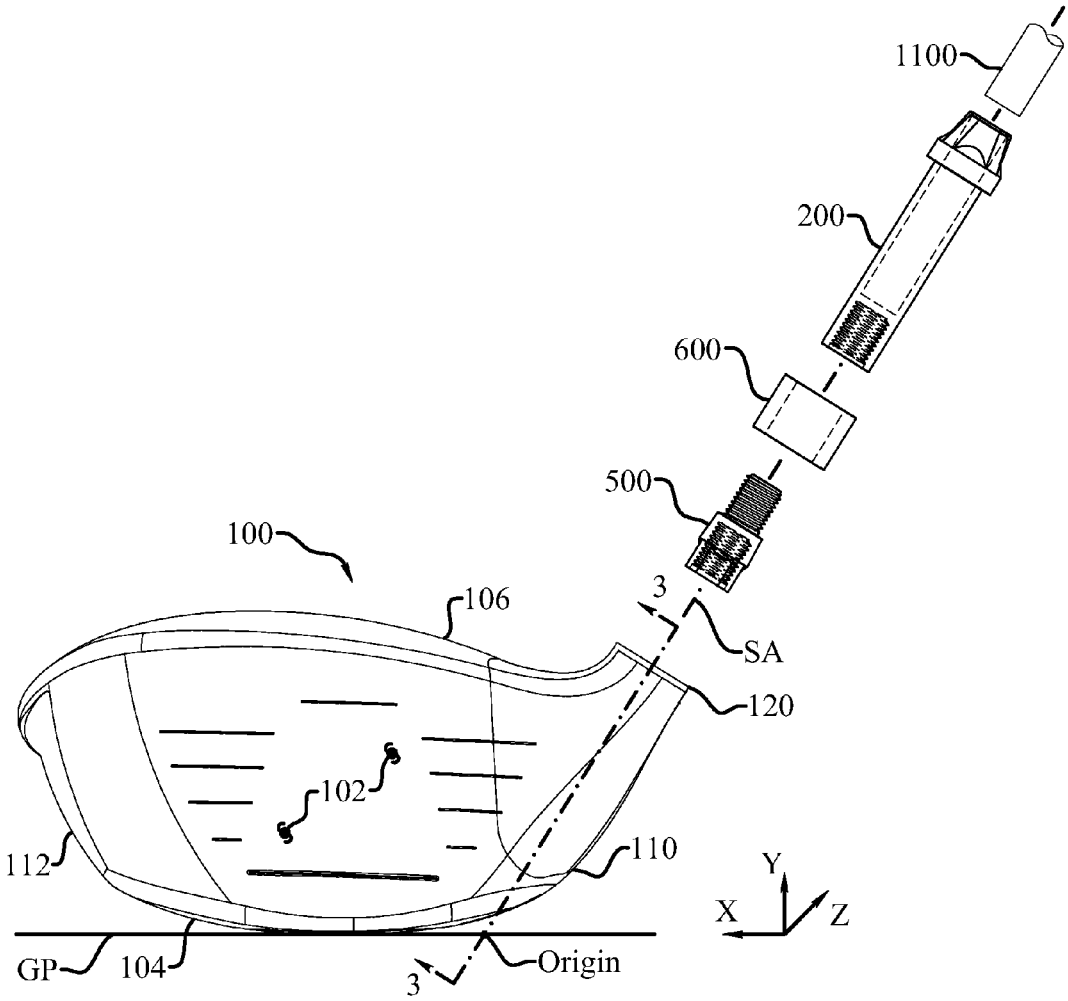
FIG. 1 is an exploded view of an embodiment of a length adjustment system for joining a golf club head to a shaft in an intermediate length configuration, not to scale.

These drawings are provided to assist in the understanding of the exemplary embodiments of the length adjustment system for joining a golf club head to a shaft as described in more detail below and should not be construed as unduly limiting the system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The presently disclosed length adjustment system for joining a golf club head (100) to a shaft (1100) enables a significant advance in the state of the art. The preferred embodiments of the length adjustment system accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the length adjustment system, and is not intended to represent the only form in which the length adjustment system may be constructed or utilized. The description sets forth the designs, functions, means, and methods of implementing the length adjustment system in connection with the illustrated embodiments. It is to be understood, however, that the same or equivalent functions and features may be accomplished by different embodiments that are also intended to be encompassed within the spirit and scope of the length adjustment system.

Figure 2:
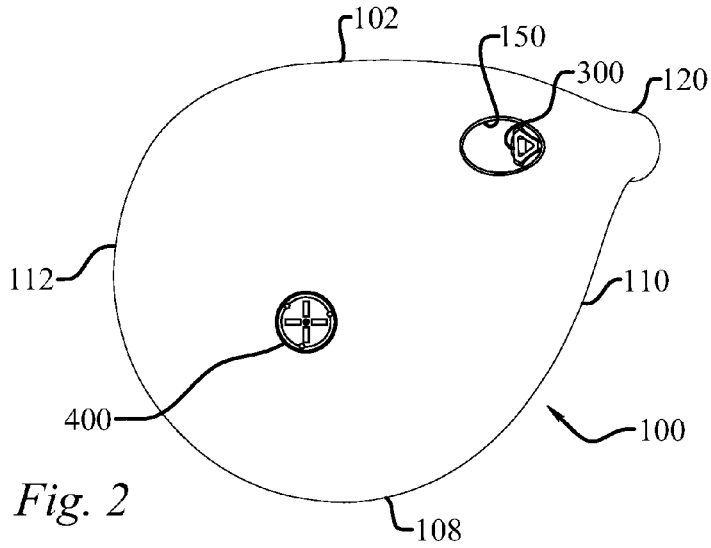
FIG. 2 is a bottom plan view of an embodiment of a golf club head, not to scale.

With reference now to FIGS. 1 and 2, an embodiment of a length adjustment system for joining a golf club head (100) to a shaft (1100) is illustrated. As seen in FIG. 1, the golf club head (100) generally includes a face (102) for striking a golf ball, a sole (104), a crown (106), a rear (108), a heel portion (110), and a toe portion (112). The golf club head (100) also includes a hosel (120) located near the heel portion (110). Those with skill in the art will understand that the term "hosel" generally refers to a bore located near the heel portion (110) of the golf club head (100) that is utilized to secure the golf club head (100) to a shaft (1100). However, it should be noted that this disclosure also applies to so-called "hosel-less" golf club heads, meaning that the golf club head does not have a discernible "neck" emanating from the crown.

As seen in FIG. 2, the golf club head (100) further includes an auxiliary hosel access (150) located on the sole (104) near the heel portion (110). In one embodiment the auxiliary hosel access (150) provides an opening on the sole (104) that is capable of receiving a retainer (300) to secure the golf club head (100) to the shaft (1100), which will be discussed in more detail below, however, the opening may not be in the sole (104) but rather through the side of the hosel (120) itself.

The shaft (1100) is preferably formed of a graphite material, although it may be formed of a metallic material, such as stainless steel or titanium. Additionally, the shaft (1100) may comprise a hybrid of graphite and metal materials.

In order to better understand the present disclosure, some common terms used herein should be defined. First, one of skill in the art will know the meaning of "center of gravity," referred to herein as CG, from an entry level course on the mechanics of solids. With respect to wood-type golf clubs, which are generally hollow and/or having non-uniform density, the CG is often thought of as the intersection of all the balance points of the golf club head. In other words, if you balance the golf club head on the face and then on the sole, the intersection of the two imaginary lines passing straight through the balance points would define the point referred to as the CG.

It is also helpful to establish a coordinate system to identify and discuss the location of the CG. In order to establish this coordinate system, one must first identify a ground plane (GP) and a shaft axis (SA). First, the ground plane (GP) is the horizontal plane upon which a golf club head rests, as seen best in a front elevation view of a golf club head (100) looking at the face (102) of the golf club head (100), as seen in FIG. 1. Secondly, the shaft axis (SA) is the axis of a bore in the golf club head (100) that is designed to receive a shaft (1100). Some golf club heads have an external hosel that contains a bore for receiving the shaft such that one skilled in the art can easily appreciate the shaft axis (SA), while other so-called "hosel-less" golf clubs have an internal bore that receives the shaft that nonetheless defines the shaft axis (SA). The shaft axis (SA) is fixed by the design of the golf club head (100) and is also illustrated in FIG. 1.

The intersection of the shaft axis (SA) with the ground plane (GP) fixes an origin point, labeled "origin" in FIG. 1, for the coordinate system. A three dimensional coordinate system may now be established from the origin with the Y-direction being the vertical direction from the origin; the X-direction being the horizontal direction perpendicular to the Y-direction and wherein the X-direction is parallel to the face (102) of the golf club head (100) in the natural resting position, also known as the design position; and the Z-direction is perpendicular to the X-direction wherein the Z-direction is the direction toward the rear (108) of the golf club head (100). The X, Y, and Z directions are noted on a coordinate system symbol in FIG. 1. It should be noted that this coordinate system is contrary to the traditional right-hand rule coordinate system; however, it is preferred so that the center of gravity may be referred to as having all positive coordinates.

Figure 10:
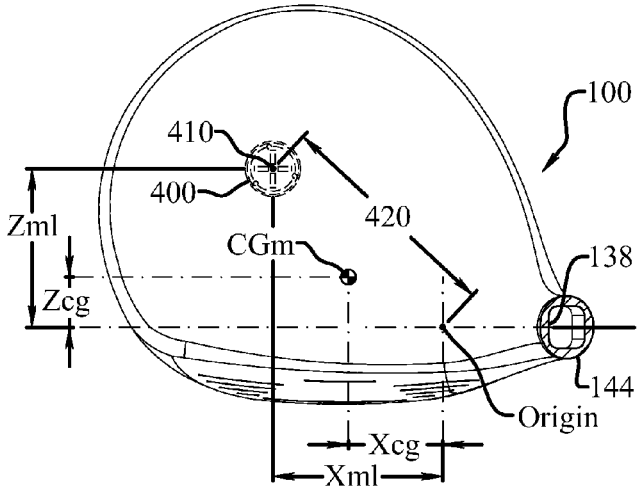
FIG. 10 is a top plan view of an embodiment of a golf club head, not to scale.

Now, with the origin and coordinate system defined, the terms that define the location of the CG may be explained. One skilled in the art will appreciate that the CG of a hollow golf club head such as the wood-type golf club head illustrated in FIG. 10 will be behind the face of the golf club head. The distance behind the origin that the CG is located is referred to as Zcg, as seen in FIG. 10. Similarly, the vertical distance above the origin that the CG is located is referred to as Ycg. Lastly, the horizontal distance from the origin that the CG is located is referred to as Xcg, as seen in FIG. 10. Therefore, the location of the CG may be easily identified by reference to Xcg, Ycg, and Zcg.

The moment of inertia of the golf club head (100) is a key ingredient in the playability of the club. Again, one skilled in the art will understand what is meant by moment of inertia with respect of golf club heads. As used herein, the term moment of inertia indicates MOIy, which is the moment of the inertia of the golf club head (100) around an axis through the CG, parallel to the Y-axis. MOIy is the moment of inertia of the golf club head (100) that resists opening and closing moments induced by ball strikes towards the heel portion (110) or the toe portion (112) of the golf club head (100).

The length adjustment system for joining a golf club head (100) to a shaft (1100) generally includes a number of components that may be utilized to create a number of golf club configurations. For example, in one embodiment, various components of the length adjustment system may be used to produce a minor length of a golf club and an intermediate length of a golf club. In another embodiment, the components of the length adjustment system may be used to produce a minor length, an intermediate length, and an extended length of a golf club. Each of the length configurations will be discussed in detail below. While the disclosure specifically notes three length configurations, those with skill in the art will appreciate that additional length configurations are possible.

Figure 3:
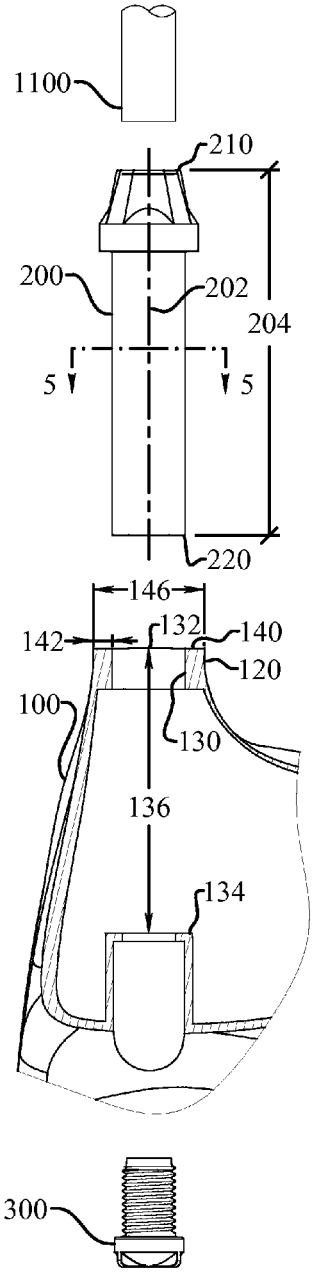
FIG. 3 is an exploded cross-sectional view of an embodiment of the length adjustment system for joining a golf club head to a shaft in a minor length configuration, not to scale.

Referring generally to FIGS. 3-10, embodiments of various components of the length adjustment system for joining a golf club head (100) to a shaft (1100) to produce a minor length configuration are shown. As seen in FIG. 3, the golf club head (100) includes a hosel (120) having a hosel bore (130) and a hosel ledge (140). The hosel bore (130) includes a hosel bore distal end (132) separated from a hosel bore proximal end (134) by a hosel bore length (136). The hosel bore (130) further includes a hosel bore cross-sectional perimeter (138), as seen in FIG. 10. Referring again to FIG. 3, the hosel ledge (140) has a hosel ledge width (142) and a hosel ledge diameter (146). The hosel ledge (140) also includes a hosel ledge surface area (144), as illustrated in FIG. 10. In an embodiment of a driver, the golf club head (100) will generally have a weight of no more than 200 grams, and more preferably weighs between 170 grams and 180 grams.

Figure 4:
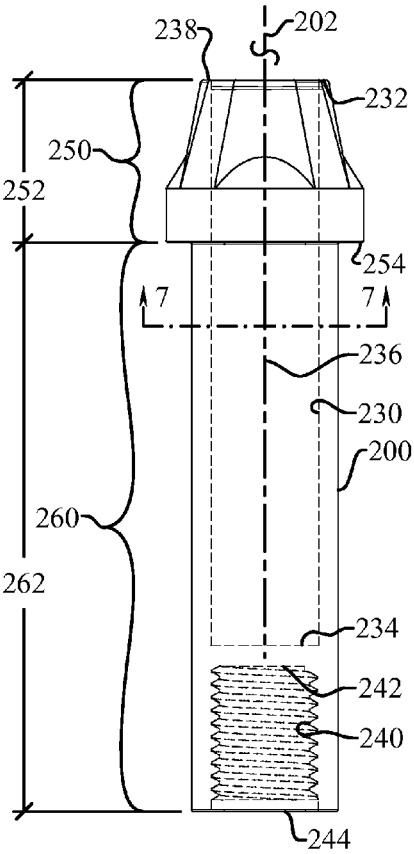
FIG. 4 is an elevation view of an embodiment of a shaft sleeve, not to scale.
Figure 7:
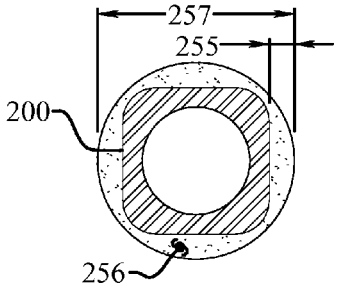
FIG. 7 is a cross-sectional view of an embodiment of a shaft sleeve taken along section line 7-7 in FIG. 4, not to scale.

With reference now to FIGS. 3 and 4, an embodiment of a shaft sleeve (200) of the length adjustment system is shown. The shaft sleeve (200) includes a shaft sleeve axis (202) and a shaft sleeve length (204) that separates a shaft sleeve distal end (210) from a shaft sleeve proximal end (220). As seen in FIG. 4, the shaft sleeve (200) includes a shaft sleeve receiving bore (230) having a receiving bore diameter (231), seen only in FIG. 5, a receiving bore distal end (232), a receiving bore proximal end (234), a receiving bore axis (236), and a receiving bore inlet edge (238). The shaft sleeve (200) further includes a shaft sleeve retainer (240) having a shaft sleeve retainer distal end (242) and a shaft sleeve retainer proximal end (244). As seen in FIGS. 4 and 7, the shaft sleeve (200) also has an exposed portion (250) including an exposed portion length (252) and a shaft sleeve ledge (254) having a ledge width (255), a ledge surface area (256), and a ledge diameter (257). Finally, the shaft sleeve (200) includes a head engagement portion (260) having an engagement portion length (262) and an engagement portion cross-sectional perimeter (264). By way of example only and not limitation, the shaft sleeve (200) may be formed of aluminum, steel, titanium, plastic, and combinations thereof, just to name a few materials. However, those with skill in the art will recognize that other materials may be used. The shaft sleeve (200) is configured to have a weight between 10 grams and 15 grams.

Figure 5:
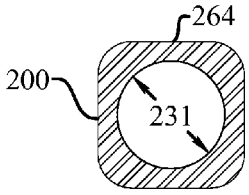
FIG. 5 is a cross-sectional view of an embodiment of a shaft sleeve taken along section line 5-5 in FIG. 3, not to scale.
Figure 8:
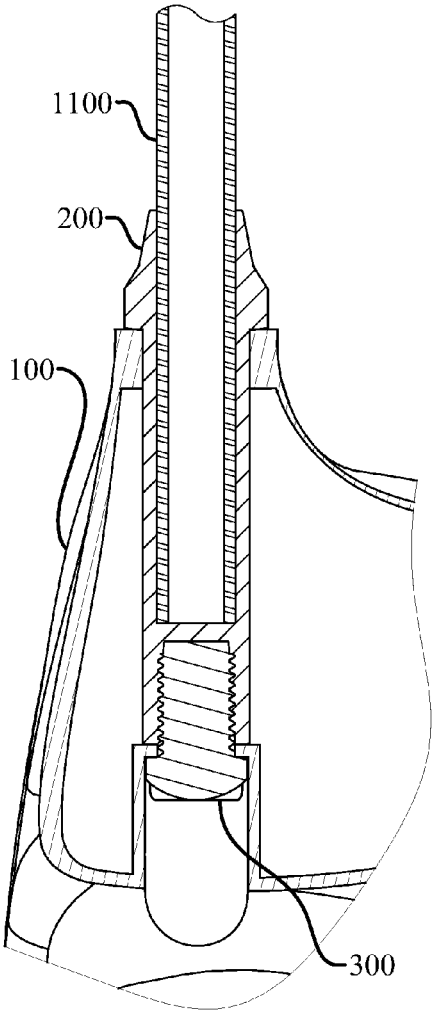
FIG. 8 is a cross-sectional view of an embodiment of a length adjustment system for joining a golf club head to a shaft in a minor length configuration, not to scale.

Referring now to FIG. 8, an assembled view of the components of the length adjustment system to produce a minor length configuration is shown. As seen in FIG. 8, the shaft sleeve (200) is attached to an end of the shaft (1100). The shaft sleeve (200) may be attached to the end of the shaft (1100) utilizing an adhesive, such as epoxy. After the shaft sleeve (200) is attached to the end of the shaft (1100), the shaft sleeve (200) is inserted into the hosel (120). As seen in FIG. 5, this particular embodiment of the shaft sleeve (200) has an engagement portion cross-sectional perimeter (264) that is square shaped with rounded corners. The hosel bore (130) is similarly configured with a hosel bore cross-sectional perimeter (138) that is square shaped with rounded corners, as seen in FIG. 10, such that the shaft sleeve (200) cooperates with the hosel (120) of the golf club head (100). The engagement portion cross-sectional perimeter (264) and the hosel bore cross-sectional perimeter (138) are designed to cooperate with one another and also impart a rotation prevention aspect to the connection, due to the non-circular cross-sections. Thus, one with skill in the art will appreciate that the engagement portion cross-sectional perimeter (264) and the hosel bore cross-sectional perimeter (138) may have configurations other than square shaped with rounded corners, such as triangular or hexagonal, just to name a couple.

When the shaft sleeve (200) and shaft (1100) are inserted into the hosel (120), a retainer (300) may be passed through the auxiliary hosel access (150) to cooperate with the shaft sleeve retainer (240) to releasably secure the shaft (1100) to the golf club head (100). As seen in FIGS. 3 and 4, the retainer (300) may be a bolt having external threads that are configured to cooperate with the internal threads of the shaft sleeve retainer (240) to provide a secure connection, or vice versa. Further, the retainer (300) may be a locking pin or locking key type of retainer. Preferably, the retainer (300) weighs between 2 grams and 5 grams. In the minor length configuration, as seen in FIG. 8, the shaft sleeve (200) is releasably secured to the golf club head (100) by the retainer (300) to produce a minor length of a golf club. In one embodiment, the minor length of the golf club may correspond to a standard length for that particular golf club (e.g., 45 inches for a driver). However, those with skill in the art will recognize that standard lengths often vary among the various golf equipment manufacturers and vary with the type of club (drivers, fairway woods, hybrids, long irons, mid-irons, short irons, wedges, putters).

Figure 9:
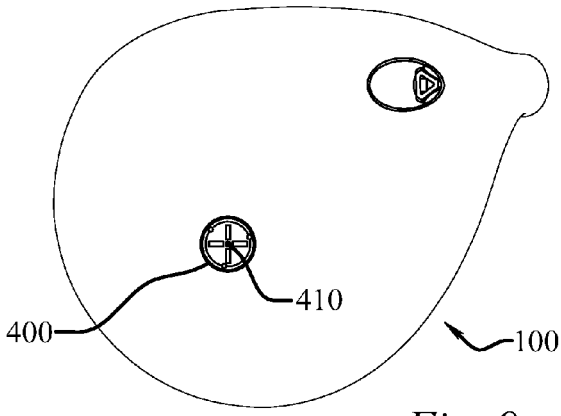
FIG. 9 is a bottom plan view of an embodiment of a golf club head, not to scale.

The length adjustment system in the minor length configuration also has a minor length weight. The minor length weight comprises the combined weight of the golf club head (100), the shaft sleeve (200), the retainer (300), and a minor length weight system (400), which is shown in FIGS. 9 and 10. The minor length weight system (400) may comprise a weight nut secured in a weight port on the sole (104) of the golf club head (100). The minor length weight system (400) generally has a weight between 12 grams and 18 grams. As seen in FIGS. 9 and 10, the minor length weight system (400) has a minor length weight system center (410) and a minor length weight system offset distance (420). The location of the minor length weight system center (410) in an X-Z plane is a distance Xml and a distance Zml from the origin, as seen in FIG. 10. The minor length weight system offset distance (420), seen in FIG. 10, is the linear distance from the origin to the minor length weight system center (410) measured in the X-Z plane. When in the minor length configuration, the minor length weight produces a minor length center of gravity (CGm) and a minor length moment of inertia. As seen in FIG. 10, the minor length center of gravity (CGm) has an X coordinate, represented by the distance Xcg from the origin, and a Z coordinate, represented by the distance Zcg from the origin. Additionally, the minor length center of gravity (CGm) has a Y coordinate (not shown), which corresponds to the vertical distance above the origin that the minor length center of gravity (CGm) is located.

Referring generally to FIGS. 11-17, embodiments of various components of the length adjustment system for joining a golf club head (100) to a shaft (1100) to produce an intermediate length configuration are shown. Just as with the minor length configuration, the intermediate length configuration features the shaft sleeve (200) attached to the end of the shaft (1100). However, to produce the intermediate length configuration additional components of the length adjustment system are required.

Figure 11:
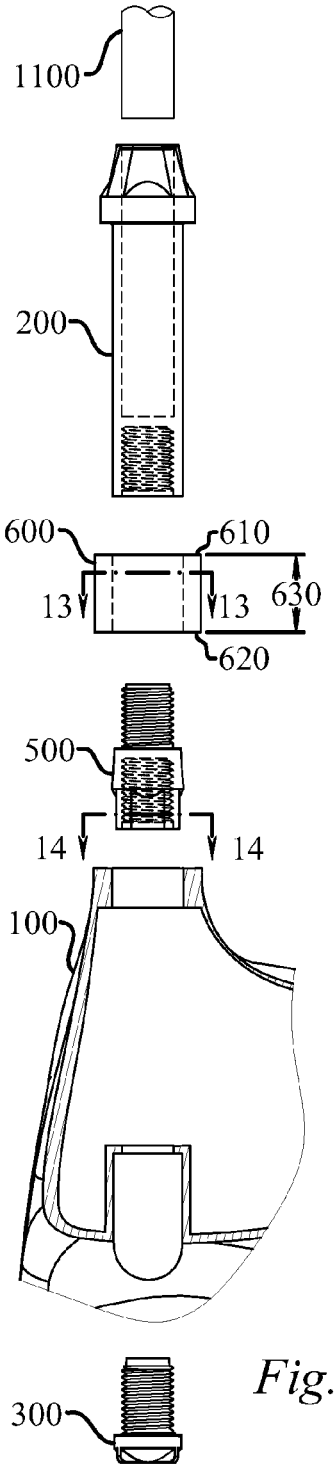
FIG. 11 is an exploded cross-sectional view of an embodiment of a length adjustment system for joining a golf club head to a shaft in an intermediate length configuration, not to scale.
Figure 12:
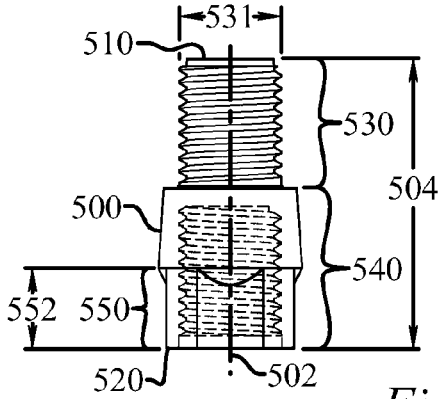
FIG. 12 is an elevation view of an embodiment of a first spacer, not to scale.

For example, the length adjustment system includes at least a first spacer (500) and at least a first hosel sleeve (600), as seen in FIG. 11. The first spacer (500) includes a first spacer axis (502) and a first spacer length (504) that separates a first spacer distal end (510) from a first spacer proximal end (520), as seen in FIG. 12. Further, the first spacer (500) includes a first spacer-to-sleeve connection portion (530) having a first spacer-to-sleeve connector diameter (531), also seen in FIG. 12. The first spacer (500) further includes a first spacer retainer portion (540) and a first spacer gripping portion (550) having a first spacer gripping portion length (552) and a first spacer gripping portion perimeter (554), seen only in FIG. 14. The first spacer gripping portion (550) is a shape that is other than round so that it may be easily gripped by a tool to facilitate its engagement with the shaft sleeve (200). By way of example only and not limitation, the first spacer (500) may be formed of aluminum, steel, titanium, plastic, and combinations thereof, just to name a few materials. However, those with skill in the art will recognize that other materials may be used. The first spacer (500) generally has a weight between 1.5 grams and 3.5 grams.

Figure 13:
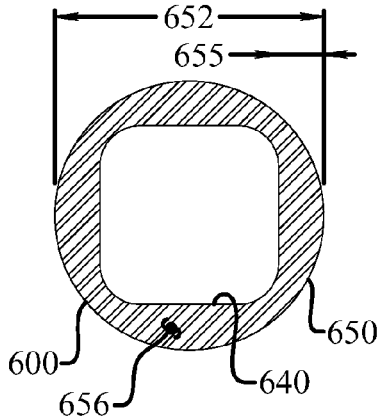
FIG. 13 is a cross-sectional view of an embodiment of a first hosel sleeve taken along section line 13-13 in FIG. 11, not to scale.
Figure 14:
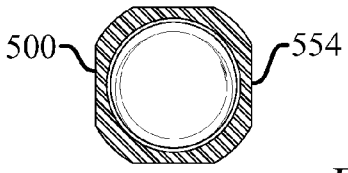
FIG. 14 is a cross-sectional view of an embodiment of a first spacer taken along section line 14-14 in FIG. 11, not to scale.

With reference now to FIGS. 11 and 13, an embodiment of the first hosel sleeve (600) is shown. The first hosel sleeve (600) includes a first hosel sleeve distal end (610) that is separated from a first hosel sleeve proximal end (620) by a first hosel sleeve length (630). As seen in FIG. 13, the first hosel sleeve (600) also includes a first hosel sleeve interior cross-sectional perimeter (640) and a first hosel sleeve exterior cross-sectional perimeter (650). Additionally, the first hosel sleeve (600) has a first hosel sleeve exterior diameter (652), a first hosel sleeve ledge width (655), and a first hosel sleeve ledge surface area (656). By way of example only and not limitation, the first hosel sleeve (600) may be formed of aluminum, steel, titanium, plastic, and combinations thereof, just to name a few materials. However, those with skill in the art will recognize that other suitable materials may be utilized. The first hosel sleeve (600) is configured to have a weight within a range of about 2.5 grams to about 5 grams. In addition to contributing to the length of the golf club, the fist hosel sleeve (600) helps stabilize the shaft sleeve (200) between the shaft sleeve ledge (254) and the hosel ledge (140) and prevents the shaft sleeve (200) from rocking, while providing a look consistent with the minor length configuration.

Figure 15:
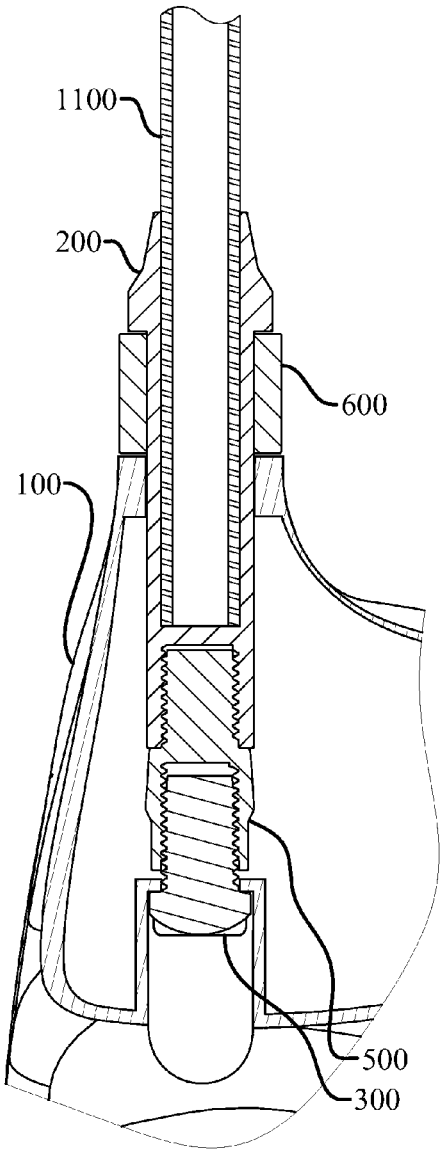
FIG. 15 is a cross-sectional view of an embodiment of a length adjustment system for joining a golf club head to a shaft in an intermediate length configuration, not to scale.

An assembled view of the components of the length adjustment system to produce an intermediate length configuration is shown in FIG. 15. As previously mentioned, the intermediate length configuration includes the shaft sleeve (200) and shaft (1100) combination described with respect to the minor length configuration. Thus, the shaft sleeve (200) will remain capable of cooperating with the hosel (120) of the golf club head (100).

In assembling the components of the length adjustment system to produce an intermediate length configuration, the first step may include securing the first spacer (500) to the shaft sleeve (200). As seen in FIG. 11, the first spacer (500) includes a first spacer-to-sleeve connector portion (530) that may comprise an externally threaded male connector that is configured to cooperate with the internal threads of the shaft sleeve retainer (240) to provide a secure connection, however other types of releasable locking connections may be utilized. Moreover, the first spacer (500) is configured for reception within the hosel (120) by having a first spacer gripping portion perimeter (554) that is capable of sliding within the hosel bore cross-sectional perimeter (138).

The next step in the assembly process may include inserting the combined first spacer (500) and shaft sleeve (200) through the first hosel sleeve (600). As seen in FIG. 13, the first hosel sleeve (600) has a first hosel sleeve interior cross-sectional perimeter (640) that is configured to receive the shaft sleeve (200) and first spacer (500). After the first spacer (500) and shaft sleeve (200) are inserted through the first hosel sleeve (600), the next step is to insert the first spacer (500) and shaft sleeve (200) into the hosel (120) so that the first hosel sleeve (600) is adjacent to the hosel (120), as seen in FIG. 15. The final step in the assembly process comprises passing the retainer (300) through the auxiliary hosel access (150) to cooperate with the first spacer retainer portion (540) to releasably secure the shaft (1100) to the golf club head (100). In one embodiment the retainer (300) is coaxial with the shaft sleeve (200) and the retainer (300) imparts a tensile load on the shaft sleeve (200), which imparts a compressive load on the first hosel sleeve (600) and forcing it to securely seat against the hosel ledge (140). As seen in FIGS. 12 and 15, the first spacer retainer portion (540) may include a bore having internal threads that are configured to cooperate with the external threads of the retainer (300) to provide a secure connection.

In the intermediate length configuration, as seen in FIG. 15, the shaft sleeve (200), the first spacer (500), and the first hosel sleeve (600) are releasably secured to the golf club head (100) by the retainer (300) to produce an intermediate length of a golf club. In one embodiment, the intermediate length of the golf club is at least ¼ inch greater than the minor length of the golf club. This embodiment provides a slight increase in golf club length, which some golfers may prefer because the increased length would be less noticeable at address and when swinging the golf club. In another embodiment, the intermediate length of the golf club is at least ½ inch greater than the minor length of the golf club. Such an embodiment would provide a more noticeable increase in golf club length, and may be preferred by golfers who are seeking to maximize their distance.

Figure 16:
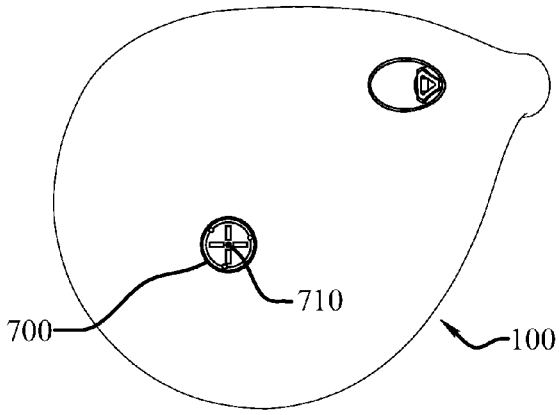
FIG. 16 is a bottom plan view of an embodiment of a golf club head, not to scale.
Figure 17:
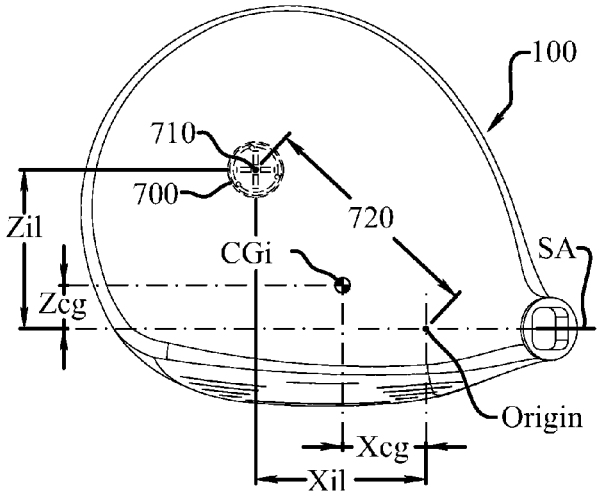
FIG. 17 is a top plan view of an embodiment of a golf club head, not to scale.

The length adjustment system in the intermediate length configuration also has an intermediate length weight. The intermediate length weight comprises the combined weight of the golf club head (100), the shaft sleeve (200), the first spacer (500), the first hosel sleeve (600), the retainer (300), and an intermediate length weight system (700), which is shown in FIGS. 16 and 17. As with the minor length weight system (400), the intermediate length weight system (700) may comprise a weight configured to cooperate with a weight port on the sole (104) of the golf club head (100). The intermediate length weight system (700) may have a weight between 4 grams and 8 grams. As seen in FIGS. 16 and 17, the intermediate length weight system (700) has an intermediate length weight system center (710) and an intermediate length weight system offset distance (720). The location of the intermediate length weight system center (710) in an X-Z plane is a distance Xil and a distance Zil from the origin, as seen in FIG. 17. The intermediate length weight system offset distance (720), seen in FIG. 17, is the linear distance from the origin to the intermediate length weight system center (710) measured in the X-Z plane. When in the intermediate length configuration, the intermediate length weight produces an intermediate length center of gravity (CGi) and an intermediate length moment of inertia. As seen in FIG. 17, the intermediate length center of gravity (CGi) has an X coordinate, represented by the distance Xcg from the origin, and a Z coordinate, represented by the distance Zcg from the origin. Additionally, the intermediate length center of gravity (CGi) has a Y coordinate (not shown), which corresponds to the vertical distance above the origin that the intermediate length center of gravity (CGi) is located.

While this particular embodiment of the length adjustment system permits a golf club to be easily transitioned between a minor length configuration and an intermediate length configuration, it does so in such a way that the characteristics of the golf club do not substantially change between the minor length configuration and the intermediate length configuration. For example, in this embodiment, the intermediate length weight is within 5 percent of the minor length weight. Thus, assuming a minor length weight of 200 grams, the intermediate length weight may be within a range of 190 grams to 210 grams. Still further, the intermediate length moment of inertia is within 10 percent of the minor length moment of inertia. For instance, assuming a minor length moment of inertia of 4000 $g*cm^2$, the intermediate length moment of inertia may be within a range of 3600 $g*cm^2$ to 4400 $g*cm^2$. Moreover, in this particular embodiment, the X, Y, and Z coordinates of the intermediate length center of gravity (CGi) are all within 15 percent of the X, Y, and Z coordinates of the minor length center of gravity (CGm). Again, for the simplicity of the example, assuming the minor length center of gravity (CGm) has an X coordinate of 1.0, a Y coordinate of 1.0, and a Z coordinate of 1.0, the intermediate length center of gravity (CGi) may have an X coordinate within a range of 0.85 to 1.15, a Y coordinate within a range of 0.85 to 1.15, and a Z coordinate within a range of 0.85 to 1.15. Thus, when changing between the minor length configuration and the intermediate length configuration, the characteristics of the golf club do not substantially change, which results in the golf club having a consistent feel in each configuration.

As noted above, the X, Y, and Z coordinates of the intermediate length center of gravity (CGi) are all within 15 percent of the X, Y, and Z coordinates of the minor length center of gravity (CGm). Moreover, it has been observed that the length adjustment system results in additional unique relationships between the intermediate length center of gravity (CGi) and the minor length center of gravity (CGm). For example, in one embodiment, the X coordinate of the intermediate length center of gravity (CGi) is less than the X coordinate of the minor length center of gravity (CGm). As a result, in this embodiment, the center of gravity of the golf club head (100) is moved closer to the heel portion (110) when increasing the length from a minor length to an intermediate length, which gives the golf club head (100) a slight draw bias. This may be desirable for golfers who tend to slice golf shots when using a longer golf club. In another embodiment, the Y coordinate of the intermediate length center of gravity (CGi) is greater than the Y coordinate of the minor length center of gravity (CGm). In this embodiment, the center of gravity of the golf club head (100) would be positioned higher on the face (102) when increasing the length from a minor length to an intermediate length. Such an embodiment may be desirable for those golfers who seek more distance, as well as improved shot control.

In addition to the relationship between the X, Y, and Z coordinates of the intermediate length center of gravity (CGi) and the minor length center of gravity (CGm), the center of gravity location for each configuration may be confined to an angle range. The angle range may be measured in an X-Z plane from the origin, representing an X-Z angle, as well as in an X-Y plane from the origin, representing an X-Y angle. For example, in one embodiment, both the intermediate length center of gravity (CGi) and the minor length center of gravity (CGm) are located between an X-Z angle of 26 degrees to 30 degrees, as may be appreciated in FIG. 26. In another embodiment, both the intermediate length center of gravity (CGi) and the minor length center of gravity (CGm) are located between an X-Y angle of 45 degrees to 60 degrees, as may be understood with reference to FIG. 27.

The insubstantial change of the golf club's characteristics between the minor length configuration and the intermediate length configuration is the result of carefully balancing the weight of each configuration and the location of the weight system (400, 700) of each configuration. For example, in one embodiment, the weight of the intermediate length weight system (700) is at least 60 percent less than the weight of the minor length weight system (400), and the combined weight of the first spacer (500) and the first hosel sleeve (600) is at least 50 percent less than the weight of the minor length weight system (400). Thus, as some weight is added toward the heel portion (110) to obtain the intermediate length configuration, less weight is added toward the toe portion (120) in the form of the intermediate length weight system (700). This careful balancing results in similar golf club characteristics when utilizing the length adjustment system to transition back and forth from a minor length configuration to an intermediate length configuration.

As previously mentioned, along with the weight of each configuration, the location of the weight system (400, 700) must be considered when moving between the minor length configuration and the intermediate length configuration so that the golf club's characteristics do not substantially change. For example, in one embodiment, a center (410) of the minor length weight system (400) in an X-Z plane and a center (710) of the intermediate length weight system (700) in the X-Z plane are both located within 20 degrees of the X-Z angle, i.e., the X-Z angle of 26 degrees to 30 degrees discussed above, as seen in FIG. 26. In another embodiment, the intermediate length weight system offset distance (720), previously described as the linear distance from the center (710) of the intermediate length weight system (700) to the origin measured in an X-Z plane, is four to six times the first spacer length (504). These particular embodiments ensure that the golf club's characteristics do not substantially change between the minor and intermediate length configurations by striking a delicate balance between the weight of each configuration and the particular location of the weight systems (400, 700). As a result, the golf club in each length configuration will have a consistent feel and level of playability.

Another unique relationship has been discovered between the location of the weight systems (400, 700) and the location of the intermediate length center of gravity (CGi). As previously described, a center (410) of the minor length weight system (400) in an X-Z plane is a distance Xml and a distance Zml from the origin. Similarly, a center (710) of the intermediate length weight system (700) the X-Z plane is a distance Xil and a distance Zil from the origin. In one embodiment, the distance Xml and the distance Xil are within a range of 1.2 to 3.5 times the X coordinate of the intermediate length center of gravity (CGi), and the distance Zml and the distance Zil are within a range of 1.7 to 7.5 times the Z coordinate of the intermediate length center of gravity (CGi). Still further, in another embodiment, the distance Xml and the distance Xil are within a range of 2.2 to 2.8 times the X coordinate of the intermediate length center of gravity (CGi), and the distance Zml and the distance Zil are within a range of 2.3 to 6.0 times the Z coordinate of the intermediate length center of gravity (CGi). Such relationships ensure that the length adjustment system may be used move between a minor length of a golf club and an intermediate length of a golf club without substantially changing the golf club's characteristics and providing a consistent feel.

Referring now to FIGS. 18-25, embodiments of various components of the length adjustment system for joining a golf club head (100) to a shaft (1100) to produce an extended length configuration are shown. Just as with the minor and intermediate length configurations, the extended length configuration features the shaft sleeve (200) attached to the end of the shaft (1100). However, to produce the extended length configuration additional components of the length adjustment system are required.

Figure 18:
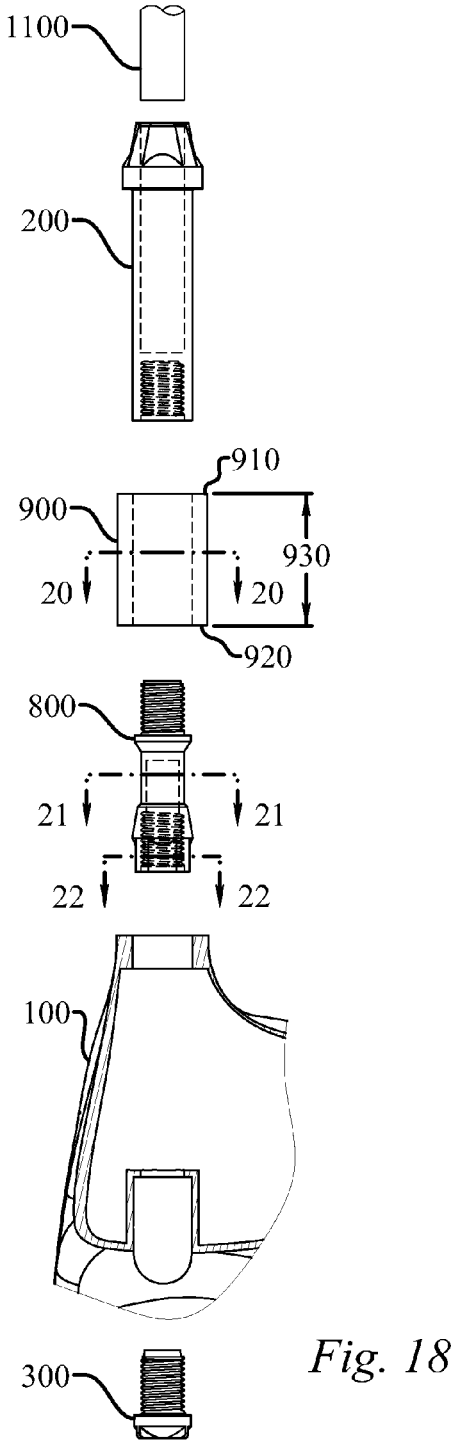
FIG. 18 is an exploded cross-sectional view of an embodiment of a length adjustment system for joining a golf club head to a shaft in an extended length configuration, not to scale.
Figure 19:
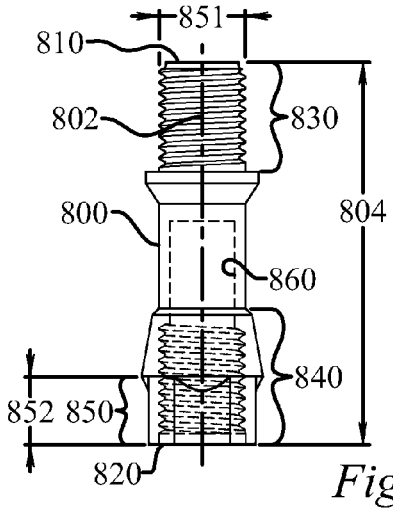
FIG. 19 is an elevation view of an embodiment of a second spacer, not to scale.

As seen in FIG. 18, the length adjustment system to produce an extended length configuration includes a second spacer (800) and a second hosel sleeve (900). The second spacer (800) includes a second spacer axis (802) and a second spacer length (804) that separates a second spacer distal end (810) from a second spacer proximal end (820), as seen in FIG. 19. Further, the second spacer (800) includes a second spacer-to-sleeve connection portion (830), which may have a second spacer-to-sleeve connector diameter (831), also seen in FIG. 19. The second spacer (800) further includes a second spacer retainer portion (840) and a second spacer gripping portion (850) having a second spacer gripping portion length (852) and a second spacer gripping portion perimeter (854), seen only in FIG. 22. Additionally, the second spacer (800) may include a second spacer weight control chamber (860), as seen in FIG. 19. The second spacer weight control chamber (860) may be left void, or additional weight may be added, so that desired golf club characteristics may be achieved. Generally, the second spacer (800) is configured to have a weight 2.5 grams and 5 grams. By way of example only and not limitation, the second spacer (800) may be formed of aluminum, steel, titanium, plastic, and combinations thereof, just to name a few materials. However, those with skill in the art will recognize that other materials may be used.

Figure 20:
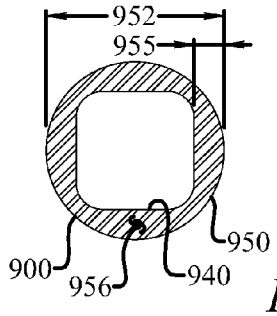
FIG. 20 is a cross-sectional view of an embodiment of a second hosel sleeve taken along section line 20-20 in FIG. 18, not to scale.
Figure 21:
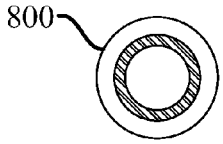
FIG. 21 is a cross-sectional view of an embodiment of a second spacer taken along section line 21-21 in FIG. 18, not to scale.
Figure 22:
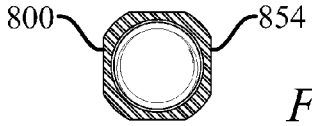
FIG. 22 is a cross-sectional view of an embodiment of a second spacer taken along section line 21-21 in FIG. 18, not to scale.

With reference now to FIGS. 18 and 20, an embodiment of the second hosel sleeve (900) is shown. The second hosel sleeve (900) includes a second hosel sleeve distal end (910) that is separated from a second hosel sleeve proximal end (920) by a second hosel sleeve length (930). As seen in FIG. 20, the second hosel sleeve (900) also includes a second hosel sleeve interior cross-sectional perimeter (940) and a second hosel sleeve exterior cross-sectional perimeter (950). Additionally, the second hosel sleeve (900) has a second hosel sleeve exterior diameter (952), a second hosel sleeve ledge width (955), and a second hosel sleeve ledge surface area (956). As with the first hosel sleeve (600), the second hosel sleeve (900) may be formed of aluminum, steel, titanium, plastic, and combinations thereof, just to name a few materials. However, those with skill in the art will recognize that other suitable materials may be utilized. The second hosel sleeve (900) preferably has a weight between 5.5 grams and 8.5 grams. In addition to contributing to the length of the golf club, the second hosel sleeve (900) beneficially stabilizes the shaft sleeve (200) between the shaft sleeve ledge (254) and the hosel ledge (140) and prevents the shaft sleeve (200) from rocking, while providing a look consistent with the minor length configuration and the intermediate length configuration.

Figure 23:
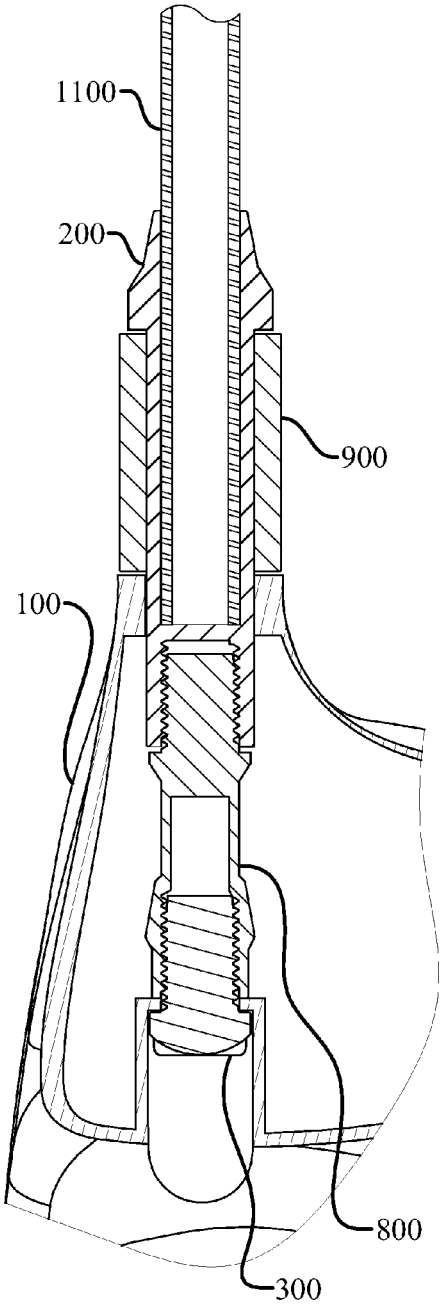
FIG. 23 is a cross-sectional view of an embodiment of a length adjustment system for joining a golf club head to a shaft in an extended length configuration, not to scale.

An assembled view of the components of the length adjustment system to produce an extended length configuration is shown in FIG. 23. As previously mentioned, the length adjustment system for producing an extended length configuration includes the same shaft sleeve (200) and shaft (1100) combination described with respect to the minor length and intermediate length configurations. As a result, the shaft sleeve (200) will remain capable of cooperating with the hosel (120) of the golf club head (100).

In assembling the components of the length adjustment system to produce an extended length configuration, the first step may include securing the second spacer (800) to the shaft sleeve (200). As seen in FIG. 18, the second spacer (800) includes a second spacer-to-sleeve connector portion (830) that may comprise an externally threaded male connector that is configured to cooperate with the internal threads of the shaft sleeve retainer (240), or vice versa, to provide a secure connection. Moreover, the second spacer (800) is configured for reception within the hosel (120) by having a second spacer gripping portion perimeter (854) that is capable passing through the hosel bore cross-sectional perimeter (138).

The next step in the assembly process may include inserting the combined second spacer (800) and shaft sleeve (200) through the second hosel sleeve (900). As seen in FIG. 20, the second hosel sleeve (900) has a second hosel sleeve interior cross-sectional perimeter (940) that is configured to receive the shaft sleeve (200) and second spacer (800). After the second spacer (800) and shaft sleeve (200) are inserted through the second hosel sleeve (900), the next step is to insert the second spacer (800) and shaft sleeve (200) into the hosel (120) so that the second hosel sleeve (900) is adjacent to the hosel (120), as seen in FIG. 23. The final step in the assembly process includes passing the retainer (300) through the auxiliary hosel access (150) to cooperate with the second spacer retainer portion (840) to releasably secure the shaft (1100) to the golf club head (100). In one embodiment the retainer (300) is coaxial with the shaft sleeve (200) and the retainer (300) imparts a tensile load on the shaft sleeve (200), which imparts a compressive load on the second hosel sleeve (900) and forcing it to securely seat against the hosel ledge (140). As seen in FIGS. 19 and 23, the second spacer retainer portion (840) may include a bore having internal threads that are configured to cooperate with the external threads of the retainer (300) to provide a secure connection.

In the extended length configuration, as seen in FIG. 23, the shaft sleeve (200), the second spacer (800), and the second hosel sleeve (900) are releasably secured to the golf club head (100) by the retainer (300) to produce an extended length of a golf club. In one embodiment, the extended length of the golf club is at least ¼ inch greater than the intermediate length of the golf club. This embodiment enables a golf club to transition between a minor length, an intermediate length, and an extended length, resulting in a golf club that may be increased in length by a total of at least ½ inch. Some golfers may prefer this particular amount of increase in length because it would be less noticeable at address and when swinging the golf club. In another embodiment, the extended length of the golf club is at least ½ inch greater than the intermediate length of the golf club, and the intermediate length of the golf club is at least ½ inch greater than the minor length of the golf club. In this embodiment, the length adjustment system may be used to increase the length of the golf club by at least 1 inch. Such an embodiment would provide a more noticeable increase in golf club length, and may be preferred by golfers who are seeking to maximize their distance.

Figure 24:
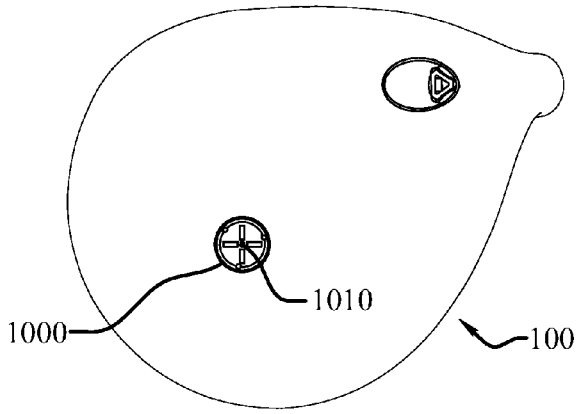
FIG. 24 is a bottom plan view of an embodiment of a golf club head, not to scale.
Figure 25:
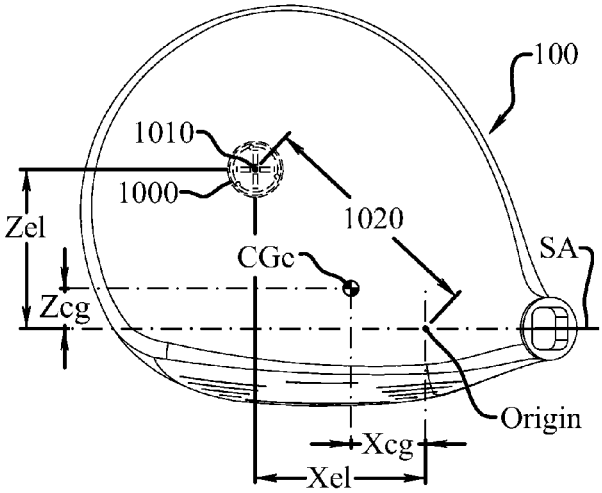
FIG. 25 is a top plan view of an embodiment of a golf club head, not to scale.

The length adjustment system in the extended length configuration also has an extended length weight. The extended length weight comprises the combined weight of the golf club head (100), the shaft sleeve (200), the second spacer (800), the second hosel sleeve (900), the retainer (300), and an extended length weight system (1000), which is shown in FIGS. 24 and 25. As with the minor length and intermediate length weight systems (400, 700), the extended length weight system (1000) may comprise a weight nut that is configured to cooperate with a weight port on the sole (104) of the golf club head (100). The extended length weight system (1000) preferably weigh between 1 gram and 3.5 grams. As seen in FIGS. 24 and 25, the extended length weight system (1000) has an extended length weight system center (1010) and an extended length weight system offset distance (1020). The location of the extended length weight system center (1010) in an X-Z plane is a distance Xel and a distance Zel from the origin, as seen in FIG. 25. The extended length weight system offset distance (1020), seen in FIG. 25, is the linear distance from the origin to the extended length weight system center (1010) measured in the X-Z plane. When in the extended length configuration, the extended length weight produces an extended length center of gravity (CGe) and an extended length moment of inertia. As seen in FIG. 25, the extended length center of gravity (CGe) has an X coordinate, represented by the distance Xcg from the origin, and a Z coordinate, represented by the distance Zcg from the origin. Additionally, the extended length center of gravity (CGe) has a Y coordinate (not shown), which corresponds to the vertical distance above the origin that the extended length center of gravity (CGe) is located.

While this particular embodiment of the length adjustment system permits a golf club to be easily transitioned between a minor length configuration, an intermediate length configuration, and an extended length configuration, it does so in such a way that the characteristics of the golf club do not substantially change between each configuration. For example, in this embodiment, the extended length weight is within 5 percent of the minor length weight. Thus, assuming a minor length weight of 200 grams, the extended length weight may be within a range of 190 grams to 210 grams. Still further, the extended length moment of inertia is within 15 percent of the minor length moment of inertia. For instance, assuming a minor length moment of inertia of 4000 $g*cm^2$, the extended length moment of inertia may be within a range of 3400 $g*cm^2$ to 4600 $g*cm^2$. Moreover, in this embodiment, the X, Y, and Z coordinates of the extended length center of gravity (CGe) are all within 15 percent of the X, Y, and Z coordinates of the intermediate length center of gravity (CGi). Assuming, for the simplicity of an example, that the intermediate length center of gravity (CGi) has an X coordinate of 1.0, a Y coordinate of 1.0, and a Z coordinate of 1.0, the extended length center of gravity (CGe) may have an X coordinate within a range of 0.85 to 1.15, a Y coordinate within a range of 0.85 to 1.15, and a Z coordinate within a range of 0.85 to 1.15. Thus, when changing between the minor length configuration, the intermediate length configuration, and the extended length configuration, the characteristics of the golf club do not substantially change, which results in the golf club having a consistent feel in each configuration.

In a further embodiment, the length adjustment system exhibits even more consistent golf club characteristics between each of the minor length, intermediate length, and extended length configurations. For example, in one embodiment, the intermediate length weight and the extended length weight are each within 2.5 percent of the minor length weight. Thus, assuming a minor length weight of 200 grams, the intermediate length weight and the extended length weight may each be within a range of 195 grams to 205 grams. Moreover, this particular length adjustment system provides an intermediate length moment of inertia that is within 5 percent of the minor length moment of inertia, and an extended length moment of inertia that is within 10 percent of the minor length moment of inertia. For instance, assuming a minor length moment of inertia of 4000 g*cm, the intermediate length moment of inertia may be within a range of 3800 $g*cm^2$ to 4200 $g*cm^2$, and the extended length moment of inertia may be within a range of 3600 $g*cm^2$ to 4400 $g*cm^2$. Still further, in this embodiment of the length adjustment system, the X, Y, and Z coordinates of the extended length center of gravity (CGe) are all within 8 percent of the X, Y, and Z coordinates of the intermediate length center of gravity (CGi). Again for the simplicity of an example, assume the intermediate length center of gravity (CGi) has an X coordinate of 1.0, a Y coordinate of 1.0, and a Z coordinate of 1.0, the extended length center of gravity (CGe) may have an X coordinate within a range of 0.92 to 1.08, a Y coordinate within a range of 0.92 to 1.08, and a Z coordinate within a range of 0.92 to 1.08. As a result, in this particular embodiment, the characteristics of the golf club are changed even less when switching between the minor length configuration, the intermediate length configuration, and the extended length configuration, which results in the golf club having a more consistent feel in each configuration.

As previously mentioned, the X, Y, and Z coordinates of the extended length center of gravity (CGe) are all within at least 15 percent of the X, Y, and Z coordinates of the intermediate length center of gravity (CGi). Moreover, it has been observed that the length adjustment system results in additional unique relationships between the extended length center of gravity (CGe) and the intermediate length center of gravity (CGi). For example, in one particular embodiment, the X coordinate of the extended length center of gravity (CGe) is less than the X coordinate of the intermediate length center of gravity (CGi). Thus, in this embodiment, the center of gravity of the golf club head (100) is moved closer to the heel portion (110) when increasing the length from an intermediate length to an extended length, which provides the golf club head (100) with a slight draw bias compared to the shorter length configuration. This may be desirable for golfers who tend to slice golf shots when using a longer golf club. In another embodiment, the Y coordinate of the extended length center of gravity (CGe) is greater than the Y coordinate of the intermediate length center of gravity (CGi). In this embodiment, the center of gravity of the golf club head (100) would be positioned higher on the face (102) when increasing the length from an intermediate length to an extended length. Such an embodiment may be desirable for those golfers who seek maximum distance, as well as improved shot control.

Figure 26:
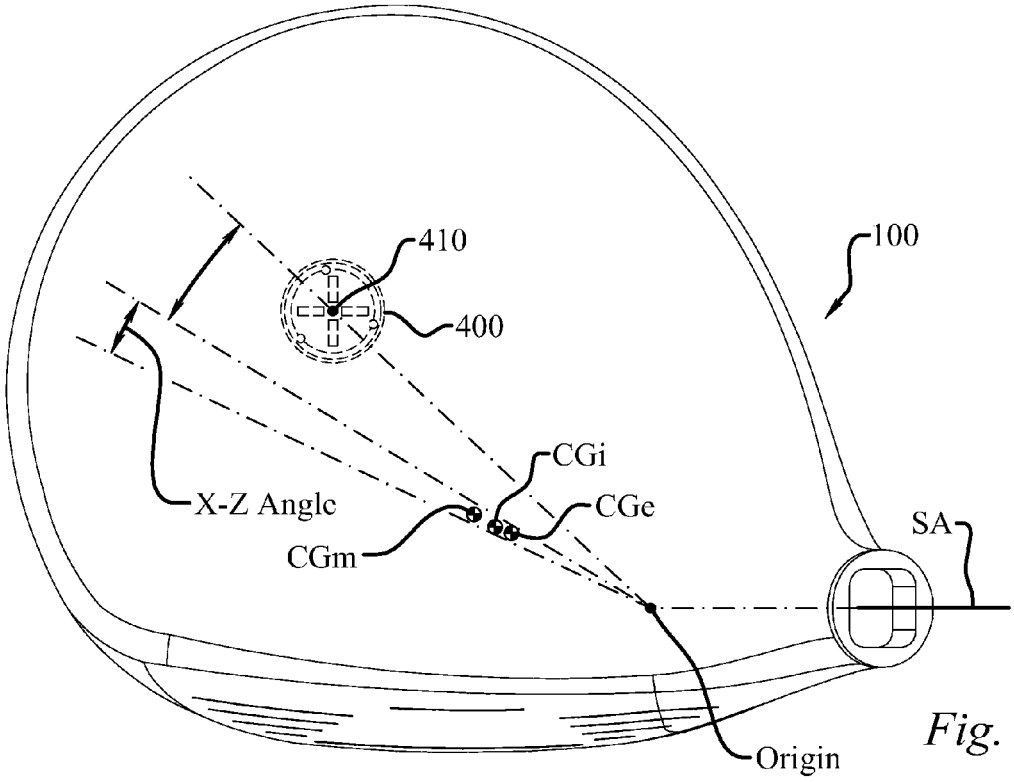
FIG. 26 is a top plan view of an embodiment of a golf club head, not to scale.
Figure 27:
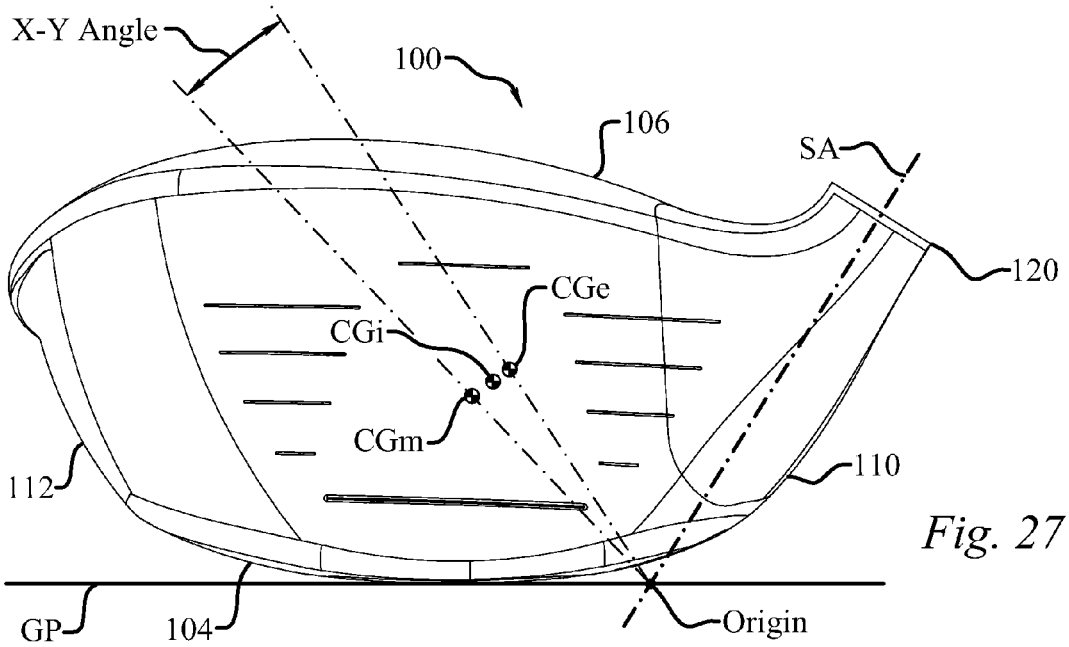
FIG. 27 is a front elevation view of an embodiment of a golf club head, not to scale.

In addition to the relationship between the X, Y, and Z coordinates of the extended length center of gravity (CGe) and the intermediate length center of gravity (CGi), and the relationship between the X, Y, and Z coordinates of the intermediate length center of gravity (CGi) and the minor length center of gravity (CGm), the center of gravity location for each configuration may be confined to an angle range. The angle range may be measured in an X-Z plane from the origin, representing an X-Z angle, as well as in an X-Y plane from the origin, representing an X-Y angle. For example, in one embodiment of the length adjustment system, the minor length center of gravity (CGm), the intermediate length center of gravity (CGi), and the extended length center of gravity (CGe) are all located between an X-Z angle of 26 degrees to 30 degrees, as seen in FIG. 26. In another embodiment of the length adjustment system, the minor length center of gravity (CGm), the intermediate length center of gravity (CGi), and the extended length center of gravity (CGe) are all located between an X-Y angle of 45 degrees to 60 degrees, as seen in FIG. 27.

As previously noted with respect to a previous embodiment of the length adjustment system, the insubstantial change of the golf club's characteristics between each configuration is the result of carefully balancing the weight of each configuration and the location of the weight system (400, 700, 1000) of each configuration, as well as the changing lengths and attributes of the first spacer (500), first hosel sleeve (600), second spacer (800) and second hosel sleeve (900). For example, in one embodiment, the weight of the extended length weight system (1000) is at least 80 percent less than the weight of the minor length weight system (400), and the combined weight of the second spacer (800) and the second hosel sleeve (900) is at least 50 percent less than the weight of the minor length system (400). Thus, as some weight is added toward the heel portion (110) from the addition of the second spacer (800) and the second hosel sleeve (900) to obtain the extended length configuration, less weight is added toward the toe portion (120) in the form of the extended length weight system (1000). This careful balancing results in similar golf club characteristics when utilizing the length adjustment system to transition between each of the length configurations.

As noted with respect to a previously discussed embodiment of the length adjustment system, the location of the weight system (400, 700, 1000) must be considered when moving between the minor length configuration, the intermediate length configuration, and the extended length configuration so that the golf club's characteristics do not substantially change. For example, in one embodiment, a center (410) of the minor length weight system (400) in an X-Z plane, a center (710) of the intermediate length weight system (700) in the X-Z plane, and a center (1010) of the extended length weight system (1000) are all located within 20 degrees of the X-Z angle, i.e., an X-Z angle of 26 degrees to 30 degrees discussed above, as seen in FIG. 26. In another embodiment, the extended length weight system offset distance (1020), previously described as the linear distance from the center (1010) of the extended length weight system (1000) to the origin measured in an X-Z plane, is two to three times the second spacer length (804). These particular embodiments ensure that the golf club's characteristics do not substantially change when switching between each configuration by striking a delicate balance between the weight of each configuration and the particular location of the weight systems (400, 700, 1000). As a result, the golf club in each length configuration will have a consistent feel and level of playability.

As noted above, a unique relationship has been discovered between the location of the weight systems (400, 700) and the location of the intermediate length center of gravity (CGi). This relationship is also applicable to the embodiment of the length adjustment system that is capable of producing a minor length, an intermediate length, and an extended length of a golf club. As previously described, a center (410) of the minor length weight system (400) in an X-Z plane is a distance Xml and a distance Zml from the origin, and a center (710) of the intermediate length weight system (700) the X-Z plane is a distance Xil and a distance Zil from the origin. Similarly, a center (1010) of the extended length weight system (1000) in the X-Z plane is a distance Xel and a distance Zel from the origin. In one embodiment of the length adjustment system, the distance Xml, the distance Xil, and the distance Xel are within a range of 1.2 to 3.5 times the X coordinate of the intermediate length center of gravity (CGi), and the distance Zml, the distance Zil, and the distance Zel are within a range of 1.7 to 7.5 times the Z coordinate of the intermediate length center of gravity (CGi). Still further, in another embodiment, the distance Xml, the distance Xil, and the distance Xel are within a range of 2.2 to 2.8 times the X coordinate of the intermediate length center of gravity (CGi), and the distance Zml, the distance Zil, and the distance Zel are within a range of 2.3 to 6.0 times the Z coordinate of the intermediate length center of gravity (CGi). Such relationships ensure that the length adjustment system may be used move between each length configuration without substantially changing the golf club's characteristics, which provides a consistent feel among each length configuration.

As can be appreciated from the foregoing, in one embodiment, the length adjustment system may be used to produce a golf club having a minor length and an intermediate length. In this particular embodiment, the length adjustment system includes a number of components, including: a shaft sleeve (200) attached to the end of a golf shaft (1100), a minor length weight system (400), a first spacer (500), a first hosel sleeve (600), an intermediate length weight system (700), and a retainer (300) for securing the shaft (1100) to the golf club head (100). In another embodiment, the length adjustment system may be used to produce a golf club having a minor length, an intermediate length, and an extended length. In this embodiment, the length adjustment system includes the same components for producing the minor length and the intermediate length along with the following additional components: a second spacer (800), a second hosel sleeve (900), and an extended length weight system (1000).

As previously mentioned, an important aspect contributing to the insubstantial change of the golf club's characteristics between each configuration is the careful balancing of the weight of each configuration. Consider the following example of the length adjustment system that may be used to produce a golf club having a minor length, an intermediate length, and an extended length. In this particular embodiment, the golf club head (100) has a weight of 175 grams, the shaft sleeve (200) weighs 12.7 grams, and the retainer (300) weighs 3.3 grams.

In another embodiment, namely the minor length configuration, the minor length weight system (400) weighs 16 grams, which when combined with the golf club head (100), the shaft sleeve (200), and the retainer (300) produces a minor length weight of 207 grams. The minor length golf club has a minor length center of gravity (CGm) with an X coordinate of 1.032", a Y coordinate of 1.137", and a Z coordinate of 0.548", and a minor length moment of inertia of 4129 g*cm$^2$.

In the intermediate length configuration, the length adjustment system further includes a first spacer (500) having a weight of 2.7 grams and a first hosel sleeve (600) having a weight of 3.9 grams. For the intermediate length configuration, the minor length weight system (400) is removed and replaced with an intermediate length weight system (700), which has a weight of 6 grams. Thus, in the intermediate length configuration, the combination of the golf club head (100), the shaft sleeve (200), the retainer (300), the first spacer (500), the first hosel sleeve (600), and the intermediate length weight system (700) produces an intermediate length weight of 203.6 grams. In the intermediate configuration, the intermediate length golf club has an intermediate length center of gravity (CGi) having an X coordinate of 0.908", a Y coordinate of 1.226", and a Z coordinate of 0.473", and an intermediate length moment of inertia of 4293 g*cm$^2$. In this example, the intermediate length is ½ inch greater than the minor length.

In the extended length configuration, the first spacer (500) and the first hosel sleeve (600) are removed and replaced with a second spacer (800) having a weight of 3.9 grams and a second hosel sleeve (900) having a weight of 7.7 grams. Moreover, in the extended length configuration, the intermediate length weight system (700) is removed and replaced with an extended length weight system (1000) having a weight of 2 grams. Thus, in the extended length configuration, the combination of the golf club head (100), the shaft sleeve (200), the retainer (300), the second spacer (800), the second hosel sleeve (900), and the extended length weight system (1000) produces an extended length weight of 204.6 grams. The extended length golf club has an extended length center of gravity (CGe) having an X coordinate of 0.813", a Y coordinate of 1.303", and a Z coordinate of 0.437", and an intermediate length moment of inertia of 4537 g*cm$^2$. In this example, the extended length is ½ inch greater than the intermediate length, and 1 inch greater than the minor length.

As may be appreciated from this example, careful balancing of the weight of each configuration leads to a golf club having substantially similar characteristics in each configuration. Thus, the length adjustment system may be used to easily increase the length of the golf club without substantially changing the golf club characteristics, which results in a consistent feel among each golf club length configuration.

Figure 6:
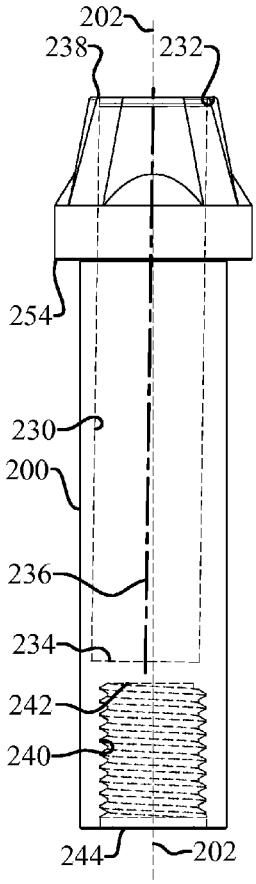
FIG. 6 is an elevation view of an embodiment of a shaft sleeve, not to scale.

In a particular embodiment, seen in FIG. 6, the length adjustment system may include a shaft sleeve (200) having a receiving bore axis (236) that is not aligned with the shaft sleeve axis (202). Preferably, the receiving bore axis (236) is offset from the shaft sleeve axis (202) by about 1 degree to about 5 degrees. As a result, when the shaft sleeve (200) and shaft (1100) combination are inserted into the hosel (120) at different orientations, the loft, lie, and face angle of the golf club may be adjusted.

Numerous alterations, modifications, and variations of the preferred embodiments disclosed herein will be apparent to those skilled in the art and they are all anticipated and contemplated to be within the spirit and scope of the disclosed length adjustment system. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the length adjustment system are described herein, it is to be understood that the practice of such additional modifications and variations and the equivalents thereof, are within the spirit and scope of the length adjustment system as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A length adjustment system for joining a golf club head (100) to a shaft (1100), comprising:

a) a shaft sleeve (200) attached to an end of the shaft (1100) that cooperates with a hosel (120) of the golf club head (100);

b) a retainer (300) releasably securing the shaft (1100) to the golf club head (100);

c) at least a first spacer (500) able to be secured within the hosel (120) by the retainer (300);

d) a first hosel sleeve (600) able to cooperate with the hosel (120) and receive the shaft sleeve (200);

e) at least a minor length weight system (400) and an intermediate length weight system (700);

f) wherein in a minor length configuration the shaft sleeve (200) is releasably secured to the golf club head (100) by the retainer (300) producing a minor length of a golf club, and the minor length configuration has a minor length weight comprising the weight of the golf club head (100), the shaft sleeve (200), the retainer (300), and the minor length weight system (400), wherein the minor length weight produces a minor length center of gravity (CGm) and a minor length moment of inertia; and g) wherein in an intermediate length configuration the shaft sleeve (200), the first spacer (500), and the first hosel sleeve (600) are releasably secured to the golf club head (100) by the retainer (300) producing an intermediate length of a golf club, and the intermediate length configuration has an intermediate length weight comprising the weight of the golf club head (100), the shaft sleeve (200), the first spacer (500), the first hosel sleeve (600), the retainer (300), and the intermediate length weight system (700), wherein the intermediate length weight produces an intermediate length center of gravity (CGi) and an intermediate length moment of inertia; and h) the intermediate length is at least ¼ inch greater than the minor length; and i) the intermediate length weight is within 5 percent of the minor length weight; and j) the intermediate length moment of inertia is within 10 percent of the minor length moment of inertia; and k) the X, Y, and Z coordinates of the intermediate length center of gravity (CGi) are all within 15 percent of the X, Y, and Z coordinates of the minor length center of gravity (CGm).

2. The length adjustment system of claim 1, further including:

a) a second spacer (800) able to be secured within the hosel (120) by the retainer (300);

b) a second hosel sleeve (900) able to cooperate with the hosel (120) and receive the shaft sleeve (200);

c) an extended length weight system (1000);

d) wherein in an extended length configuration the shaft sleeve (300), the second spacer (800), and the second hosel sleeve (900) are releasably secured to the golf club head (100) by the retainer (300) producing an extended length of a golf club, and the extended length configuration has an extended length weight comprising the weight of the golf club head (100), the shaft sleeve (200), the second spacer (800), the second hosel sleeve (900), the retainer (300), and the extended length weight system (1000), wherein the extended length weight produces an extended length center of gravity (CGe) and an extended length moment of inertia; and e) the extended length is at least ¼ inch greater than the intermediate length; and f) the extended length weight is within 5 percent of the minor length weight; and g) the extended length moment of inertia is within 15 percent of the minor length moment of inertia; and h) the X, Y, and Z coordinates of the extended length center of gravity (CGe) are all within 15 percent of the X, Y, and Z coordinates of the intermediate length center of gravity (CGi).

3. The length adjustment system of claim 2, wherein the intermediate length is at least ½ inch greater than the minor length, and the extended length is at least ½ inch greater than the intermediate length.

4. The length adjustment system of claim 2, wherein a) the intermediate length weight and the extended length weight are within 2.5 percent of the minor length weight; and b) the intermediate length moment of inertia is within 5 percent of the minor length moment of inertia, and the extended length moment of inertia is within 10 percent of the minor length moment of inertia; and c) the X, Y, and Z coordinates of the extended length center of gravity (CGe) are all within 8 percent of the X, Y, and Z coordinates of the intermediate length center of gravity (CGi).

5. The length adjustment system of claim 2, wherein the X coordinate of the extended length center of gravity (CGe) is less than the X coordinate of the intermediate length center of gravity (CGi).

6. The length adjustment system of claim 2, wherein the extended length center of gravity (CGe), the intermediate length center of gravity (CGi), and the minor length center of gravity (CGm) are located between an X-Z angle of 26 degrees to 30 degrees.

7. The length adjustment system of claim 6, wherein a center (410) of the minor length weight system (400) in an X-Z plane, a center (710) of the intermediate length weight system (700) in the X-Z plane, and a center (1010) of the extended length weight system (1000) in an X-Z plane, are all located within 20 degrees of the X-Z angle.

8. The length adjustment system of claim 2, wherein the extended length center of gravity (CGe), the intermediate length center of gravity (CGi), and the minor length center of gravity (CGm) are located between an X-Y angle of 45 degrees to 60 degrees.

9. The length adjustment system of claim 2, wherein the golf club head (100) includes a hosel bore (130) having a center that defines a shaft axis (SA) which intersects with a horizontal ground plane (GP) to define an origin, and wherein a center (1010) of the extended length weight system (1000) is an extended length weight system offset distance (1020) from the origin in an X-Z plane, the second spacer (800) has a second spacer length (804), and the extended length weight system offset distance (1020) is two to three times the second spacer length (804).

10. The length adjustment system of claim 2, wherein the Y coordinate of the extended length center of gravity (CGe) is greater than the Y coordinate of the intermediate length center of gravity (CGi).

11. The length adjustment system of claim 2, wherein the weight of the extended length weight system (1000) is at least 80% less than the weight of the minor length weight system (400), and the combined weight of the second spacer (800) and the second hosel sleeve (900) is at least 25% less than the weight of the minor length weight system (400).

12. The length adjustment system of claim 2, wherein the golf club head (100) includes a hosel bore (130) having a center that defines a shaft axis (SA) which intersects with a horizontal ground plane (GP) to define an origin, and wherein a center (410) of the minor length weight system (400) in an X-Z plane is a distance Xml and a distance Zml from the origin, a center (710) of the intermediate length weight system (700) in the X-Z plane is a distance Xil and a distance Zil from the origin, and a center (1010) of the extended length weight system (1000) in the X-Z plane is a distance Xel and a distance Zel from the origin, wherein the distance Xml, the distance Xil, and the distance Xel are within a range of 1.2 to 3.5 times the X coordinate of the intermediate length center of gravity (CGi), and the distance Zml, the distance Zil, and the distance Zel are within a range of 1.7 to 7.5 times the Z coordinate of the intermediate length center of gravity (CGi).

13. The length adjustment system of claim 12, wherein the distance Xml, the distance Xil, and the distance Xel are within a range of 2.2 to 2.8 times the X coordinate of the intermediate length center of gravity (CGi), and the distance Zml, the distance Zil, and the distance Zel are within a range of 2.3 to 6 times the Z coordinate of the intermediate length center of gravity (CGi).

14. The length adjustment system of claim 1, wherein the X coordinate of the intermediate length center of gravity (CGi) is less than the X coordinate of the minor length center of gravity (CGm).

15. The length adjustment system of claim 1, wherein both the intermediate length center of gravity (CGi) and the minor length center of gravity (CGm) are located between an X-Z angle of 26 degrees to 30 degrees.

16. The length adjustment system of claim 15, wherein a center (410) of the minor length weight system (400) in an X-Z plane and a center (710) of the intermediate length weight system (700) in the X-Z plane are both located within 20 degrees of the X-Z angle.

17. The length adjustment system of claim 1, wherein both the intermediate length center of gravity (CGi) and the minor length center of gravity (CGm) are located between an X-Y angle of 45 degrees to 60 degrees.

18. The length adjustment system of claim 1, wherein the golf club head (100) includes a hosel bore (130) having a center that defines a shaft axis (SA) which intersects with a horizontal ground plane (GP) to define an origin, and wherein a center (710) of the intermediate length weight system (700) is an intermediate length weight system offset distance (720) from the origin in an X-Z plane, the first spacer (500) has a first spacer length (504), and the intermediate length weight system offset distance (720) is four to six times the first spacer length (504).

19. The length adjustment system of claim 1, wherein the Y coordinate of the intermediate length center of gravity (CGi) is greater than the Y coordinate of the minor length center of gravity (CGm).

20. The length adjustment system of claim 1, wherein the weight of the intermediate length weight system (700) is at least 60% less than the weight of the minor length weight system (400), and the combined weight of the first spacer (500) and the first hosel sleeve (600) is at least 50% less than the weight of the minor length weight system (400).

21. The length adjustment system of claim 1, wherein the golf club head (100) includes a hosel bore (130) having a center that defines a shaft axis (SA) which intersects with a horizontal ground plane (GP) to define an origin, and wherein a center (410) of the minor length weight system (400) in an X-Z plane is a distance Xml and a distance Zml from the origin, and a center (710) of the intermediate length weight system (700) in the X-Z plane is a distance Xil and a distance Zil from the origin, wherein the distance Xml and the distance Xil are within a range of 1.2 to 3.5 times the X coordinate of the intermediate length center of gravity (CGi), and the distance Zml and the distance Zil are within a range of 1.7 to 7.5 times the Z coordinate of the intermediate length center of gravity (CGi).

22. The length adjustment system of claim 21, wherein the distance Xml and the distance Xil are within a range of 2.2 to 2.8 times the X coordinate of the intermediate length center of gravity (CGi), and the distance Zml and the distance Zil are within a range of 2.3 to 6.0 times the Z coordinate of the intermediate length center of gravity (CGi).

* * * * *